US007963321B2

(12) United States Patent
Kutac

(10) Patent No.: US 7,963,321 B2
(45) Date of Patent: Jun. 21, 2011

(54) SWELLABLE DOWNHOLE PACKER

(75) Inventor: Andrew Kutac, Hallettsville, TX (US)

(73) Assignee: Tam International, Inc., Houston, TX (US)

( * ) Notice: Subject to any disclaimer, the term of this patent is extended or adjusted under 35 U.S.C. 154(b) by 217 days.

(21) Appl. No.: 12/466,440

(22) Filed: May 15, 2009

(65) Prior Publication Data

US 2010/0288486 A1 Nov. 18, 2010

(51) Int. Cl.
*E21B 23/00* (2006.01)

(52) U.S. Cl. ..... 166/187; 166/179

(58) Field of Classification Search ..... 166/179, 166/187; 277/334, 335, 337
See application file for complete search history.

(56) References Cited

U.S. PATENT DOCUMENTS

| | | | | |
|---|---|---|---|---|
| 3,502,149 | A | 3/1970 | Pence, Jr. et al. | |
| 4,137,970 | A | 2/1979 | Laflin et al. | |
| 4,161,319 | A | 7/1979 | Stocking | |
| 4,424,861 | A * | 1/1984 | Carter et al. | 277/334 |
| 4,484,626 | A * | 11/1984 | Kerfoot et al. | 166/191 |
| 4,633,950 | A | 1/1987 | Delhommer et al. | |
| 5,195,583 | A | 3/1993 | Toon et al. | |
| 6,223,820 | B1 * | 5/2001 | Carisella | 166/187 |
| 6,286,603 | B1 * | 9/2001 | Parent | 166/387 |
| 6,443,458 | B1 * | 9/2002 | Jansch | 277/336 |
| 7,331,581 | B2 * | 2/2008 | Xu et al. | 277/334 |
| 7,392,851 | B2 * | 7/2008 | Brennan et al. | 166/387 |
| 7,431,098 | B2 * | 10/2008 | Ohmer et al. | 166/387 |
| 7,597,152 | B2 * | 10/2009 | Wood et al. | 166/387 |
| 7,661,471 | B2 * | 2/2010 | Murray et al. | 166/179 |
| 7,665,537 | B2 * | 2/2010 | Patel et al. | 166/387 |
| 2004/0020062 | A1 | 2/2004 | Ducret | |
| 2007/0144734 | A1 * | 6/2007 | Xu et al. | 166/187 |
| 2009/0211770 | A1 * | 8/2009 | Nutley et al. | 166/387 |
| 2009/0242189 | A1 * | 10/2009 | Vaidya et al. | 166/134 |
| 2009/0250228 | A1 * | 10/2009 | Loretz et al. | 166/387 |
| 2009/0272546 | A1 * | 11/2009 | Nutley et al. | 166/387 |
| 2010/0038074 | A1 * | 2/2010 | Patel | 166/187 |
| 2010/0170682 | A1 * | 7/2010 | Brennan et al. | 166/387 |
| 2010/0288511 | A1 * | 11/2010 | Corre et al. | 166/387 |

FOREIGN PATENT DOCUMENTS

| | | | |
|---|---|---|---|
| EP | 1315883 | B1 | 3/2006 |
| WO | WO0220941 | A1 | 3/2002 |

* cited by examiner

*Primary Examiner* — Giovanna C Wright
*Assistant Examiner* — Sonya Bible
(74) *Attorney, Agent, or Firm* — Browning Bushman P.C.

(57) ABSTRACT

A swellable downhole packer (10) is provided for positioning downhole in a well to seal with the interior surface of a borehole or the interior surface of a downhole tubular. The packer includes a swellable elastomeric sleeve-shaped body (14) positioned over a mandrel (12) for swelling, and a rigid end ring (16,18). An elastomeric anti-extrusion member (20) is spaced axially between the sleeve-shaped body and the rigid end ring, and has a radial thickness adjacent the end ring greater than the radial thickness adjacent the sleeve-shaped body. A swellable elastomeric member (32) is spaced radially between the exterior surface of the mandrel and the elastomeric anti-extrusion member.

20 Claims, 1 Drawing Sheet

SWELLABLE DOWNHOLE PACKER

FIELD OF THE INVENTION

The present invention relates to downhole packers for forming a seal in an annulus between an inner tubular and either an outer tubular or a borehole wall, or forming a plug with the outer tubular or borehole wall. More particularly, this invention relates to an improved swellable downhole packer which maintains a reliable seal in response to various fluid pressures and temperatures.

BACKGROUND OF THE INVENTION

Various types of downhole packers have been devised over the past century, including inflatable packers, compression set packers, and swab cup packers. One form of a compression packer with a central rubber section and upper and lower rubber sections having a higher durometer than the central section is disclosed in U.S. Pat. No. 4,161,319. Several embodiments of compression set packers include petal shaped end ring elements which bend and thus radially expand in response to high compressive forces, so that the effective diameter of the end ring when the packer is run in the well is less than the effective diameter of the end ring when the packer is set. These type of expanding end rings are complex, and require a significant axial force to deflect these petal shaped elements while setting the compression set packer. Various types of compression set packers, for example, require an axial setting force in excess of 50,000 pounds to reliably set the packer.

In more recent years, swellable packers have been commercialized which expand in response to downhole fluids, and thus do not require a setting mechanism or a setting operation. Suitable examples of swellable packers include U.S. Pat. Nos. 3,502,149, 4,137,970, 4,633,950. More recent patents and publications are U.S. Pat. No. 5,195,583, U.S. Publication 2004/0020062A1, WO 02120941A1, and EP1315883B1.

A swellable elastomer typically has a low modulus of rigidity and a low molecular weight, and accordingly will flow axially if a high pressure differential is applied to one end of the swelled elastomer. The swellable elastomeric element of a packer may be partially prevented from extruding axially during radial expansion by a rigid end ring secured to the packer mandrel and resisting axial extrusion of the elastomer. In some applications, the rigid end ring and the swellable element each have a diameter that is slightly less than the diameter of the well bore. Since the radial space between the O.D. of the swellable element and the borehole wall or between the O.D. of the swellable element and the I.D. of a larger concentric tubular may be about 3/16 inch or more, a reasonable differential pressure applied to the swelled element will cause flow or extrusion of the element into this radial space outward of the end ring, eventually negating the pressure seal.

The disadvantages of the prior art are overcome by the present invention, and an improved swellable downhole packer is hereinafter disclosed which maintains high reliability in response high downhole temperatures and pressures.

SUMMARY OF THE INVENTION

In one embodiment, a swellable packer is provided for positioning downhole in a well to seal with the interior surface of a borehole or the interior surface of the downhole tubular. The packer includes a mandrel having a central axis, and an exterior generally cylindrical surface. A swellable elastomeric sleeve-shaped body may be bonded to the exterior surface of the mandrel. A rigid end ring is positioned over the exterior surface of the mandrel and axially secured to the mandrel. At least one elastomeric anti-extrusion member is spaced axially between a swellable sleeve-shaped body and the rigid end ring, with the anti-extrusion member having a modulus of rigidity substantially greater than a modulus of rigidity in the swellable sleeve-shaped body. A radial thickness of the anti-extrusion member adjacent the rigid end ring is preferably greater than a radial thickness of the anti-extrusion member adjacent the swellable sleeve-shaped body. A swellable elastomeric member is spaced radially between the exterior surface of the mandrel and the elastomeric anti-extrusion member adjacent the swellable sleeve-shaped body, so that swelling of the elastomeric member forces at least a portion of the elastomeric anti-extrusion member into engagement with the interior surface of the borehole or the interior surface of a downhole tubular.

These and further features and advantages of the present invention will become apparent from the following detailed description, wherein reference is made to the figures in the accompanying drawings.

DETAILED DESCRIPTION OF PREFERRED EMBODIMENTS

Figure 1:
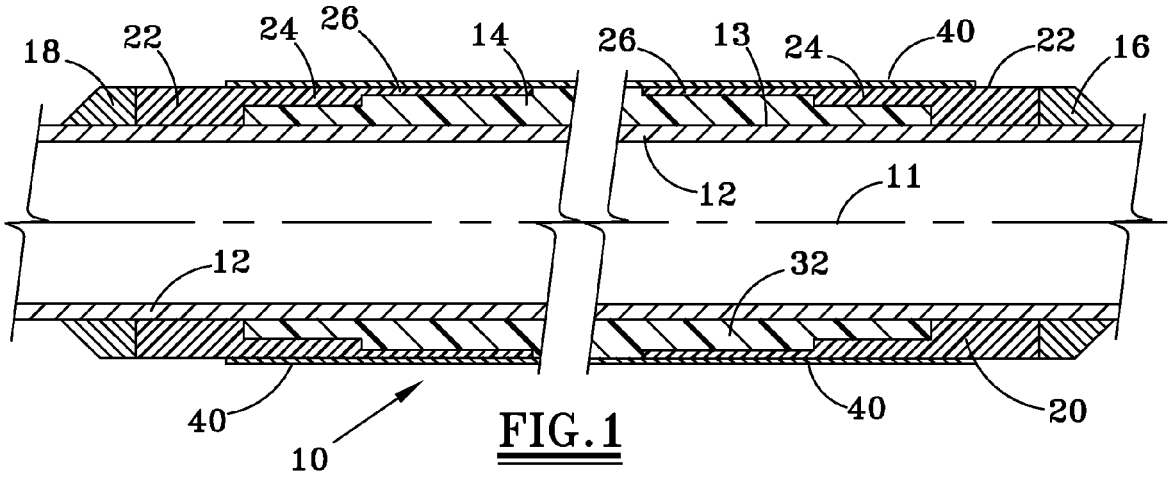
FIG. 1 is a cross-sectional view of a swellable downhole packer according to the present invention.

FIG. 1 illustrates one embodiment of a swellable packer 10 for positioning downhole in a well to seal with either the interior surface of a borehole or an interior surface of a downhole tubular. Those skilled in the art appreciate that the central axis 11 of the packer 10 as shown in FIG. 1 is thus generally aligned with the central bore of the borehole or the central bore of the tubular in the well when the packer 10 is lowered to the desired depth in the well. The central packer axis will also be generally aligned with this bore when the packer performs its sealing function.

In the FIG. 1 embodiment, the packer includes a metal mandrel 12 having a central axis aligned with the axis 11 and a generally exterior cylindrical surface 13. The mandrel as shown in FIG. 1 is generally tubular, so that fluid may pass through the bore of the set packer. Along a substantial length of this mandrel, a swellable elastomeric sleeve-shaped body 14 is positioned over the exterior surface of the mandrel. This body 14 is designed to swell in response to either water and/or hydrocarbons so that swelling creates a seal between the mandrel and the interior surface of either the borehole or the downhole tubular. To limit axial movement of the elastomeric sleeve-shaped body 14 as it radially swells, the packer is provided with a rigid end ring 16, 18 at each end, with each end ring being positioned over the exterior surface of the mandrel and secured to the mandrel, e.g., by one or more set screws.

The present invention provides an elastomeric anti-extrusion member 20 which is spaced axially between the swellable sleeve-shaped body 14 and each rigid end ring. This elastomeric anti-extrusion member 20 has a modulus of rigidity which is substantially greater than a modulus of rigidity of the swellable sleeve-shaped body 14. As shown in FIG. 1, the anti-extrusion member 20 has a radial thickness adjacent the rigid end ring 16 which is greater than the radial thickness of the anti-extrusion member adjacent the swellable sleeve-shaped body. Spaced radially between the exterior surface of the mandrel and the elastomeric anti-extrusion member is a swellable elastomeric member 32 which swells in response to downhole fluids in a manner similar to the swellable elastomeric sleeve-shaped body 14. This swelling of the elastomeric member causes radially outward movement of that portion of the anti-extrusion member 20 confined under the anti-extrusion member, particularly toward the end adjacent the sleeve-shaped body 14, so that the anti-extrusion member radially engages the wall of the borehole or the interior surface of the downhole tubular. This anti-extrusion member is less elastic than the elastomeric sleeve-shaped body or the elastomeric member, and contains the swellable sleeve-shaped body to prevent its extrusion past the end ring.

In a preferred embodiment, the swellable elastomeric sleeve-shaped body is homogenous with and integral with the swellable elastomeric member. Moreover, the swellable elastomeric sleeve-shaped body may be bonded to the exterior, generally cylindrical surface of the mandrel, and the swellable elastomeric member may be similarly bonded to the mandrel. The elastomeric anti-extrusion member may also be bonded to both the swellable elastomeric member and the rigid end ring. In a preferred embodiment as shown in FIG. 1, the two ends of the packer may be functionally identical to minimize or prevent extrusion in either direction in response to a pressure differential across the packer. The second rigid end ring 18 and a corresponding second anti-extrusion member and swellable elastomeric member are shown on the left side of FIG. 1. The axial length of the sleeve-shaped body 14 is not depicted, but generally may be several feet or more in axial length to provide a reliable seal.

As shown in FIG. 1, anti-extrusion member 20 has a generally stair-stepped configuration, with a radial thickness of portion 22 being greater than a radial thickness of portion 24, which is greater than a radial thickness of portion 26. The radial thickness of the anti-extrusion thus decreases in a direction axially away from the end ring 16.

In a preferred embodiment, the outer diameters of a swellable sleeve-shaped body, the elastomeric anti-extrusion member, and the rigid end ring are substantially the same prior to swelling of the elastomeric sleeve-shaped body, thereby promoting reliable positioning of the packer in a well before swelling. As shown in FIG. 1, a sleeve-shaped wrapping 40 covers an exterior surface of the swellable elastomeric sleeve-shaped body, and optionally a portion of the anti-extrusion member 20.

Figure 2:
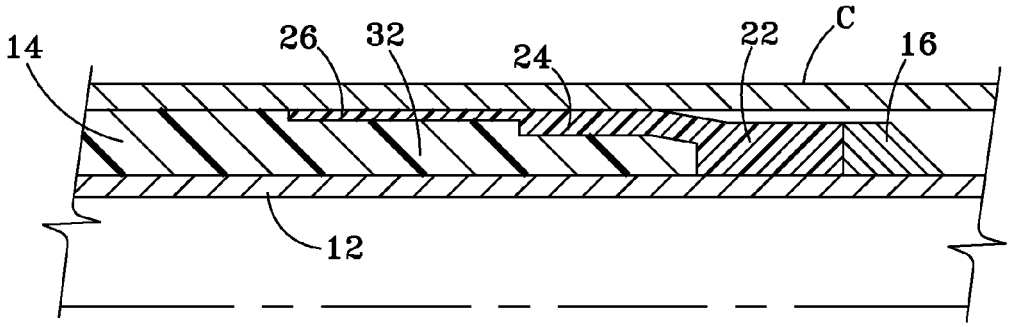
FIG. 2 is a cross-sectional view of a portion of the packer shown in FIG. 1 when expanded downhole.

Referring now to FIG. 2, a portion of the packer shown in FIG. 1 is shown after swelling of the sleeve-shaped body 14, so that the sleeve-shaped body and a radially outer portion of the elastomeric anti-extrusion member engage the casing C and effectively prevent the elastomeric sleeve-shaped body from extruding axially past the end ring 16. The radial thickness of both the elastomeric sleeve-shaped body and the swellable elastomeric member have thus increased compared to FIG. 1, forcing the anti-extrusion member into engagement with the casing C.

Figure 3:
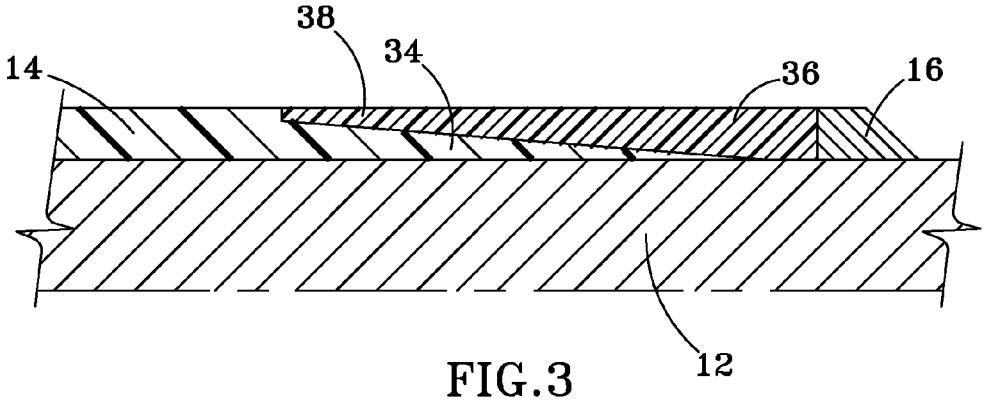
FIG. 3 is a cross-sectional view of a portion of another embodiment of a swellable downhole packer.

FIG. 3 depicts a portion of another embodiment of a swellable packer. In this case, the elastomeric anti-extrusion member has a substantially frustoconical interior surface along a substantial portion of its length, and the swellable elastomeric member 32 similarly has a mating frustoconical exterior surface along a portion of its length. FIG. 3 also depicts the mandrel 12 as being a solid cylindrical member, rather than a tubular member, so that in this case the packer does not have a central bore for transmitting fluid through the packer, and instead the packer once swelled essentially constitutes a plug. A tubular mandrel or a plugged mandrel may be used in different applications. The design as shown in FIG. 3 achieves the objective of the design as shown in FIG. 2 in that the radially thinner sections of the anti-extrusion member are provided axially adjacent the sleeve-shaped body 14, while the radially thicker portions of the anti-extrusion member are provided adjacent the rigid end ring 16. With respect to central axis 11, the conical surface has an angle of less than 20°, and preferably less than about 15°.

For each of the embodiments shown in FIGS. 1 and 3, that portion of the anti-extrusion member whose internal surface is substantially out of engagement with the outer surface of the mandrel 12, e.g., portions 24 and 26 as shown in FIG. 1, preferably has a pre-swelling or tool run-in volume which is less than the run-in volume of the swellable elastomeric member 32 spaced under the anti-extrusion member and over the mandrel 12. Alternatively, the swellable elastomeric volume spaced under the anti-extrusion member is at least 70% of that portion of the anti-extrusion member out of engagement with the outer surface of the mandrel, e.g., portions 24 and 26. This feature desirably provides a relatively large amount of the swellable elastomeric member which swells to cause radially outward movement of the anti-extrusion member, forcing the anti-extrusion member into engagement with the inner wall of the casing, as shown in FIG. 2. For the FIG. 3 embodiment, the volume of the swellable elastomeric member 34 may be increased by providing a slightly curved interface between the anti-extrusion member and the swellable elastomeric member, thereby providing an axially longer section of the relatively thin portion of the anti-extrusion member.

To promote enhanced high pressure sealing capability, the present invention provides a swellable packer which effectively prevents elastomeric extrusion past an end ring by placing a flexible anti-extrusion member between the swellable sleeve-shaped body and the end ring. The end rings are rigid, and may be fabricated from metal or a thermoplastic material. This elastomeric anti-extrusion member provides support for the swelled sleeve-shaped body once subjected to a pressure differential. The anti-extrusion member has a higher modulus of rigidity than that of the swellable elastomeric body, but significantly less than that of the rigid end ring. The elastomeric anti-extrusion member preferably is pliable enough to deform into the space between the end ring and the wellbore, yet sufficiently inflexible to withstand without extrusion or flowing when the swellable elastomeric body is exposed to a significant pressure differential.

A preferred anti-extrusion member may have properties of 90 to 95 Shore A durometer, a 250% maximum elongation, 1,000 psi tensile strength, and 320° vulcanization temperature. The anti-extrusion member reduces the extrusion gap in the annular area, yet is sufficiently stiff to act as a barrier for the swellable elastomer. A suitable anti-extrusion member's swell capability may be less than 5% by volume, depending on the chemical formulation of the anti-extrusion member. The swell capability of both the elastomeric body 14 and the elastomeric member 32 may be 100% or greater, and frequently is 150% or greater. A preferred anti-extrusion member has a high molecular weight of at least 500,000, which compares to the molecular weight of the elastomeric body of from 500 to 5,000. The anti-extrusion member also has a high modulus of rigidity (shearing modulus) compared to the modulus of rigidity of the swellable elastomeric sleeve-shaped body, e.g., an anti-extrusion member modulus of rigidity of from 4,000 psi to 7,000 psi, and preferably from 5,000 psi to 6,000 psi, while the elastomeric body has a modulus of rigidity of from 200 psi to 600 psi, and preferably from 300 psi to 500 psi.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A swellable packer for positioning downhole in a well to seal with the interior surface of a borehole or an interior surface of a downhole tubular, comprising:

a mandrel having a central axis and an exterior generally cylindrical surface;

a swellable elastomeric sleeve-shaped body positioned over a portion of the exterior surface of the mandrel for swelling to seal between the mandrel and the interior surface of the borehole or the interior surface of the downhole tubular;

a rigid end ring positioned over the exterior surface of the mandrel and axially secured to the mandrel;

an elastomeric anti-extrusion member spaced axially between the swellable sleeve-shaped body and the rigid end ring, the elastomeric anti-extrusion member having a modulus of rigidity substantially greater than a modulus of rigidity of the swellable sleeve-shaped body, the elastomeric anti-extrusion member having a radial thickness adjacent the rigid end ring greater than a radial thickness of the elastomeric anti-extrusion member adjacent the swellable sleeve-shaped body; and a swellable elastomeric member spaced radially between the exterior surface of the mandrel and the elastomeric anti-extrusion member adjacent the swellable sleeve-shaped body.

2. A swellable packer as defined in claim 1, wherein the swellable elastomeric sleeve-shaped body is homogeneous and integral with the swellable elastomeric member.

3. A swellable packer as defined in claim 1, wherein each of the swellable elastomeric sleeve-shaped body and the swellable elastomeric member is bonded to the generally cylindrical exterior surface of the mandrel.

4. A swellable packer as defined in claim 1, wherein an outer diameter of each of the swellable sleeve-shaped body, the rigid end ring, and the elastomeric anti-extrusion member is substantially uniform prior to swelling of the elastomeric sleeve-shaped body.

5. A swellable packer as defined in claim 1, wherein the elastomeric anti-extrusion member is bonded to the swellable elastomeric member and to the rigid end ring.

6. A swellable packer as defined in claim 1, further comprising:

another rigid end ring positioned over the exterior surface of the mandrel and secured to the mandrel;

another elastomeric anti-extrusion member spaced axially between the swellable sleeve-shaped body and the another rigid end ring, the another elastomeric anti-extrusion member having a modulus of rigidity substantially greater than a modulus of rigidity of the swellable sleeve-shaped body, the elastomeric anti-extrusion member having a radial thickness adjacent the another rigid end ring greater than the radial thickness of the elastomeric anti-extrusion member adjacent the swellable sleeve-shaped body; and another swellable elastomeric member spaced radially between the exterior surface of the mandrel and the another elastomeric anti-extrusion member adjacent the swellable sleeve-shaped body.

7. A swellable packer as defined in claim 1, wherein the elastomeric anti-extrusion member has a stair-stepped configuration, such that the radial thickness of the elastomeric anti-extrusion member axially spaced from the rigid end ring is less than the radial thickness of the elastomeric anti-extrusion member adjacent the rigid end ring.

8. A swellable packer as defined in claim 1, wherein a radial interior surface of the elastomeric anti-extrusion member is a substantially frustoconical surface.

9. A swellable packer as defined in claim 1, further comprising:

a sleeve-shaped wrapping covering an exterior surface of the swellable elastomeric sleeve-shaped body and at least a portion of the elastomeric anti-extrusion member.

10. A swellable packer as defined in claim 1, wherein the elastomeric anti-extrusion member has a maximum radial thickness at an axial end adjacent the rigid end ring and a minimum radial thickness at an axial end adjacent the swellable elastomeric sleeve-shaped body, such that a straight line interconnecting an interface of the interior surface of the anti-extrusion member and the exterior generally cylindrical surface of the mandrel and an interior surface of the anti-extrusion member and the swellable elastomeric sleeve-shaped body is less than 20° relative to the mandrel central axis.

11. A swellable packer as defined in claim 1, wherein the anti-extrusion member swells less than 5% by volume under conditions wherein the swellable elastomeric sleeve-shaped body swells by at least 100% by volume.

12. A swellable packer as defined in claim 1, wherein the elastomeric anti-extrusion member has a molecular weight of at least 500,000.

13. A swellable packer as defined in claim 1, wherein the elastomeric anti-extrusion member has a tensile strength of at least 4,000 psi.

14. A swellable packer for positioning downhole in a well to seal with the interior surface of a borehole or an interior surface of a downhole tubular, comprising:

a mandrel having a central axis and an exterior generally cylindrical surface;

a swellable elastomeric sleeve-shaped body bonded to the exterior generally cylindrical surface of the mandrel for swelling to seal between the mandrel and the interior surface of the borehole or the interior surface of the downhole tubular;

a rigid end ring positioned over the exterior surface of the mandrel and secured to the mandrel;

an elastomeric anti-extrusion member spaced axially between the swellable sleeve-shaped body and the rigid end ring, the elastomeric anti-extrusion member having a modulus of rigidity substantially greater than a modulus of rigidity of the swellable sleeve-shaped body, the elastomeric anti-extrusion member having a radial thickness adjacent the rigid end ring greater than a radial thickness of the elastomeric anti-extrusion member adjacent the swellable sleeve-shaped body;

a swellable elastomeric member spaced radially between the exterior surface of the mandrel and the elastomeric anti-extrusion member adjacent the swellable sleeve-shaped body;

another rigid end ring positioned over the exterior surface of the mandrel and secured to the mandrel;

another elastomeric anti-extrusion member spaced axially between the swellable sleeve-shaped body and the another rigid end ring, the another elastomeric anti-extrusion member having a modulus of rigidity substantially greater than a modulus of rigidity of the swellable sleeve-shaped body, the elastomeric anti-extrusion member having a radial thickness adjacent the another rigid end ring greater than the radial thickness of the elastomeric anti-extrusion member adjacent the swellable sleeve-shaped body; and another swellable elastomeric member spaced radially between the exterior surface of the mandrel and the another elastomeric anti-extrusion member adjacent the swellable sleeve-shaped body.

15. A swellable packer as defined in claim 14, wherein the swellable elastomeric sleeve-shaped body is homogeneous and integral with the swellable elastomeric member.

16. A swellable packer as defined in claim 14, wherein the elastomeric anti-extrusion member is bonded to the swellable elastomeric member and to the rigid end ring.

17. A swellable packer as defined in claim 14, wherein an outer diameter of each of the swellable sleeve-shaped body, the rigid end ring, and the elastomeric anti-extrusion member is substantially uniform prior to swelling of the elastomeric sleeve-shaped body.

18. A swellable packer for positioning downhole in a well to seal with the interior surface of a borehole or an interior surface of a downhole tubular, comprising:

a mandrel having a central axis and an exterior generally cylindrical surface;

a swellable elastomeric sleeve-shaped body bonded to the exterior, generally cylindrical surface of the mandrel for swelling to seal between the mandrel and the interior surface of the borehole or the interior surface of the downhole tubular;

a rigid end ring positioned over the exterior surface of the mandrel and secured to the mandrel;

an elastomeric anti-extrusion member spaced axially between the swellable sleeve-shaped body and the rigid end ring and bonded to both the exterior generally cylindrical surface of the mandrel and to the rigid end ring, the elastomeric anti-extrusion member having a modulus of rigidity substantially greater than a modulus of rigidity of the swellable sleeve-shaped body, the elastomeric anti-extrusion member having a radial thickness adjacent the rigid end ring greater than a radial thickness of the elastomeric anti-extrusion member adjacent the swellable sleeve-shaped body; and a swellable elastomeric member bonded to the exterior generally cylindrical surface of the mandrel and spaced radially between the exterior surface of the mandrel and the elastomeric anti-extrusion member adjacent the swellable sleeve-shaped body.

19. A swellable packer as defined in claim 18, wherein the swellable elastomeric sleeve-shaped body in homogeneous and integral with the swellable elastomeric member.

20. A swellable packer as defined in claim 18, wherein the elastomeric anti-extrusion member has a tensile strength of at least 4,000 psi.

* * * * *